US006881156B1

(12) United States Patent
Phillips

(10) Patent No.: US 6,881,156 B1
(45) Date of Patent: Apr. 19, 2005

(54) GOLF TRAINING AID

(76) Inventor: Philip S. Phillips, 756 Chenango St., Binghamton, NY (US) 13901

( * ) Notice: Subject to any disclaimer, the term of this patent is extended or adjusted under 35 U.S.C. 154(b) by 31 days.

(21) Appl. No.: 10/806,138

(22) Filed: Mar. 23, 2004

(51) Int. Cl.[7] ..... A63B 69/36
(52) U.S. Cl. ..... 473/228
(58) Field of Search ..... 473/228, 226, 473/422, 437, 463, 457; D21/791

(56) References Cited

U.S. PATENT DOCUMENTS 3,565,444 A * 2/1971 La Rocca ..... 473/228
3,809,397 A * 5/1974 Gruenewald ..... 473/457
5,100,148 A * 3/1992 Smith ..... 473/228
5,165,683 A * 11/1992 Beutler et al. ..... 473/228
5,184,825 A * 2/1993 Ruth ..... 473/228
5,207,625 A * 5/1993 White ..... 482/111
5,310,188 A * 5/1994 Hernberg ..... 473/206
5,395,107 A * 3/1995 De Pippo ..... 473/451
5,415,406 A * 5/1995 Reichenbach et al. ..... 473/228
5,571,048 A * 11/1996 Kenney ..... 473/228
D441,043 S 4/2001 Barnette
6,238,299 B1 * 5/2001 Barnette ..... 473/228
D468,790 S * 1/2003 Brooks et al. ..... D21/791
2003/0207719 A1 * 11/2003 Hughes ..... 473/228

* cited by examiner

*Primary Examiner*—Raleigh W. Chiu
(74) *Attorney, Agent, or Firm*—Richard C. Litman

(57) ABSTRACT

A foldable, air-resistance golf training includes an elongated flexible hub of rubber or similar material being stretchable between a rectangular configuration for transport and storage and a generally cylindrical, stretched configuration wrapping around a golf club shaft. The flexible hub in the cylindrical configuration has parallel, paddle-shaped vanes spaced around and extending radially outward from the hub along the substantial length thereof. The flexible hub assumes the rectangular folded configuration at rest with the vanes parallel to each other. The vanes are inserted into spaced, parallel retaining slots cut lengthwise through the outer surface of the hub, spaced between the parallel sides and extending inward toward the inner side of the hub Extension paddles may be attached to the vanes to be rotated from a closed position and an open position extending outward and upward from the vane.

20 Claims, 17 Drawing Sheets

GOLF TRAINING AID

BACKGROUND OF THE INVENTION

1. Field of the Invention

The present invention relates to sports training aids. More particularly, the present invention relates to golf training aids attachable to a golf club shaft which add air resistance to the swing.

2. Description of the Related Art

The game of golf is a popular and growing sport requiring considerable skill to play well. Also, better results are achieved when hitting the golf ball for distance if the muscles used during the swing are strengthened and trained. Many devices are available to aid in practicing a swing in order to keep the swing in the desired line. An important aspect of the swing is the "release" point where the energy stored in the backswing and the cocking of the wrists is released during the process of hitting the ball with the club. The "release" point, i.e., the breaking or uncocking of the wrists should occur just before ball contact with the club in order to obtain maximum club head speed and creating maximum power for long ball hitting. The proper release point is also important in the process of hitting the ball correctly to avoid hook, slice, and other miss-hits of the ball with the club head.

It has been discovered that adding air resistance to a club along its shaft accentuates the effort exerted at the release point of the swing, allowing the golfer to more easily recognize the release point of his swing and adjust it accordingly. The repeated swinging of the club with the added air resistance helps train the golfer to release at the appropriate point of his swing. The effect of repeated swinging is to strengthen and teach the lead side muscles and promote "muscle memory" for the release point. Also, the weight of the unit, when removed, would make the club feel lighter, resulting in the golfer feeling more confident in executing his swing for long hitting. It would be desirable to provide a golf training device which may easily be mounted, dismounted and carried during a round of golf which provides wind resistance and weight as described above, allowing the golfer to practice swings with particular clubs used during the round. The training device would also have varying degrees of wind resistance for various skill levels and different clubs. The training device should be capable of secure mounting to avoid turning on the shaft while avoiding damage to the shaft through undue compression, allowing the shaft to flex naturally during the swing.

U.S. Design Pat. No. D441,043 S, issued Apr. 24, 2001, to Barnette, depicts a golf club shaft-attachable air-resistance device having a plurality of vanes extending lengthwise of the shaft.

U.S. Pat. No. 5,310,188, issued May 10, 1994, to Hernberg, describes a golf club swing alignment device having finned members that is secured along the shaft of a conventional golf club adjacent the head. The fins provide wind resistance during the swing.

U.S. Pat. No. 5,571,048, issued Nov. 5, 1996, to Kenney, describes a golf swing practice device having a plurality of plastic rigid airfoil wings which are attached to a golf shaft just above the head. The wings provide air resistance during the swinging of the golf club while training the user in proper rotation of the club during the swing.

U.S. Pat. No. 6,238,299 B1, issued May 29, 2001, to Barnette describes a golf training air resistance device which attaches along the length of a golf club and describes how it is manipulated to fit all standard shaft diameters.

None of the above inventions and patents, taken either singly or in combination, is seen to describe the instant invention as claimed. Thus a golf training aid solving the aforementioned problems is desired.

SUMMARY OF THE INVENTION

The foldable, air-resistance golf training aid of the present invention includes an elongated flexible hub of rubber or similar material being stretchable between a rectangular configuration for transport and storage and a generally cylindrical configuration wrapping around a golf club shaft. The flexible hub in the cylindrical wrapped configuration has a plurality of parallel, paddle-shaped vanes spaced around and extending radially outward from the hub along the substantial length thereof. The flexible hub assumes the rectangular folded configuration at rest with the vanes parallel to each other to form a compact unit for carrying and storage in a golf bag during a round of golf. The hub in the rectangular configuration has upper and lower ends and parallel sides.

The vanes are preferably inserted into spaced, parallel retaining slots cut lengthwise through the outer surface of the hub, spaced between the parallel sides and extending inward about two-thirds of the hub thickness toward the inner side of the hub. The vanes are preferably of clear plastic of about 1/16 inch thickness, having a straight edge fitting into its respective slot in the hub and a rounded form similar to the end portion of a paddle.

The hub preferably has five slots spaced at 1/8 inch intervals receiving an outer pair of vanes spaced inward, respectively, from the sides of the hub, an intermediate pair of vanes spaced inward respectively from the outer pair of vanes, and a center pair of vanes, preferably sharing a single center groove. The vanes are retained in the respective grooves by mounting with adhesive to the wall of each groove closest to the nearest sidewall, the center pair of vanes being mounted on opposite walls of the center groove, respectively. At least one fastener is attached between the outer pair of vanes, preferably a strap of loop material glued to one vane and a hook material patch on the other vane, to detachably hold the vanes together in the stored position. The hook and loop material is available under the name VELCRO.

The hub is mounted on the golf club shaft for use by wrapping it lengthwise around the shaft forming a tubular or cylindrical hub, the vanes extending radially outward from the hub. The outer pair of vanes is then adjustably attached by a fastener such as a strap. It is convenient to use a double-sided strap of loop material mounted to one of the outer pair of vanes to serve as the storage fastener and the attachment fastener, and corresponding hook material patches mounted on opposed sides of the other outer vane receiving the strap for detachable, adjustable mounting. Extension paddles may be attached to the vanes as desired by axle rivets so the paddles may be rotated from a closed position conforming with the vane and an open position extending outward and upward from the vane to provide the golf training aid with increased and variable air-resistance capability.

It is an aspect of the invention to include improved elements and arrangements thereof for the purposes described which is inexpensive, dependable and fully effective in accomplishing its intended purposes.

These and other aspects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
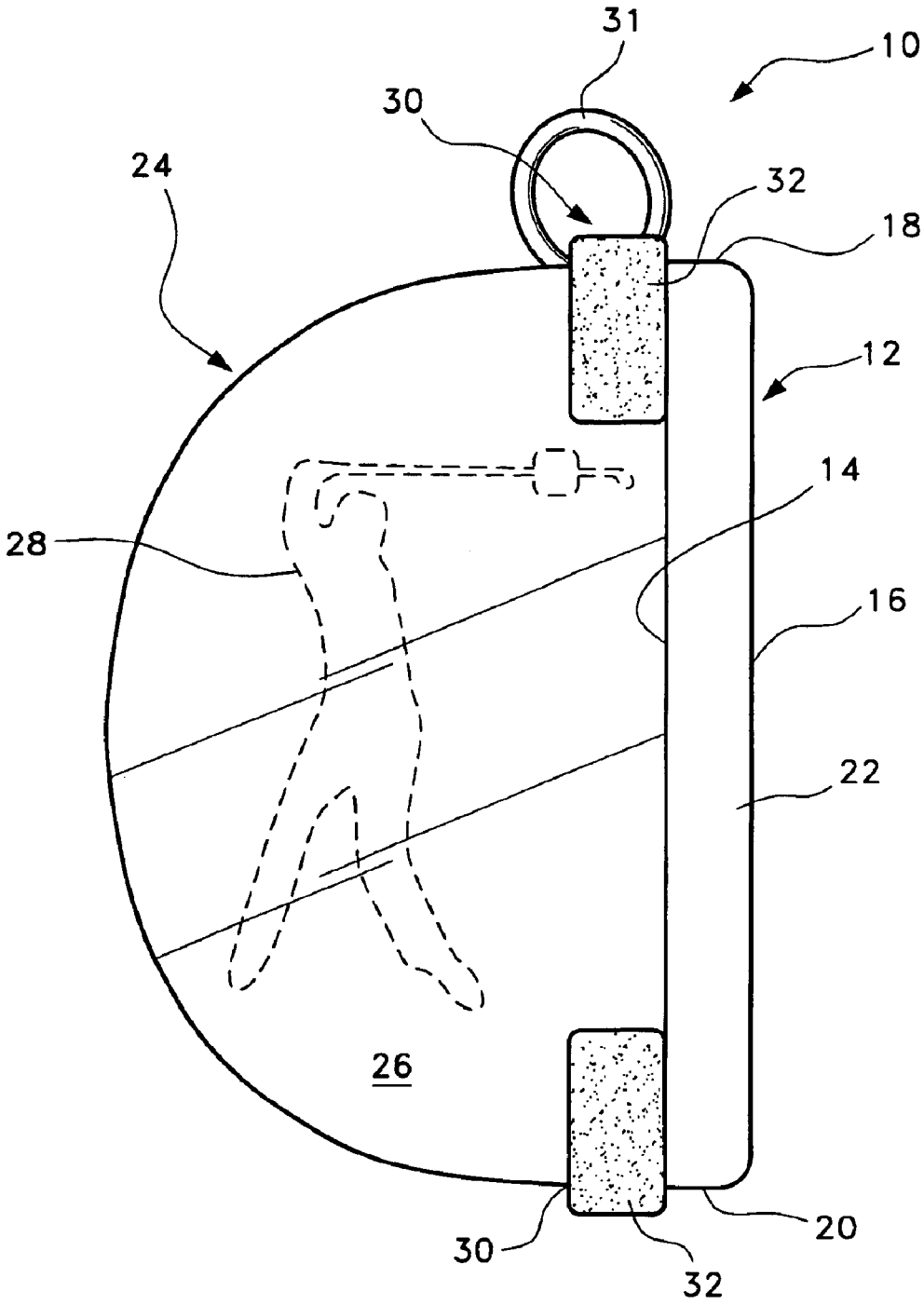
FIG. 1 is a front elevation view of the golf training aid of the present invention in the folded or stored configuration.
Figure 2:
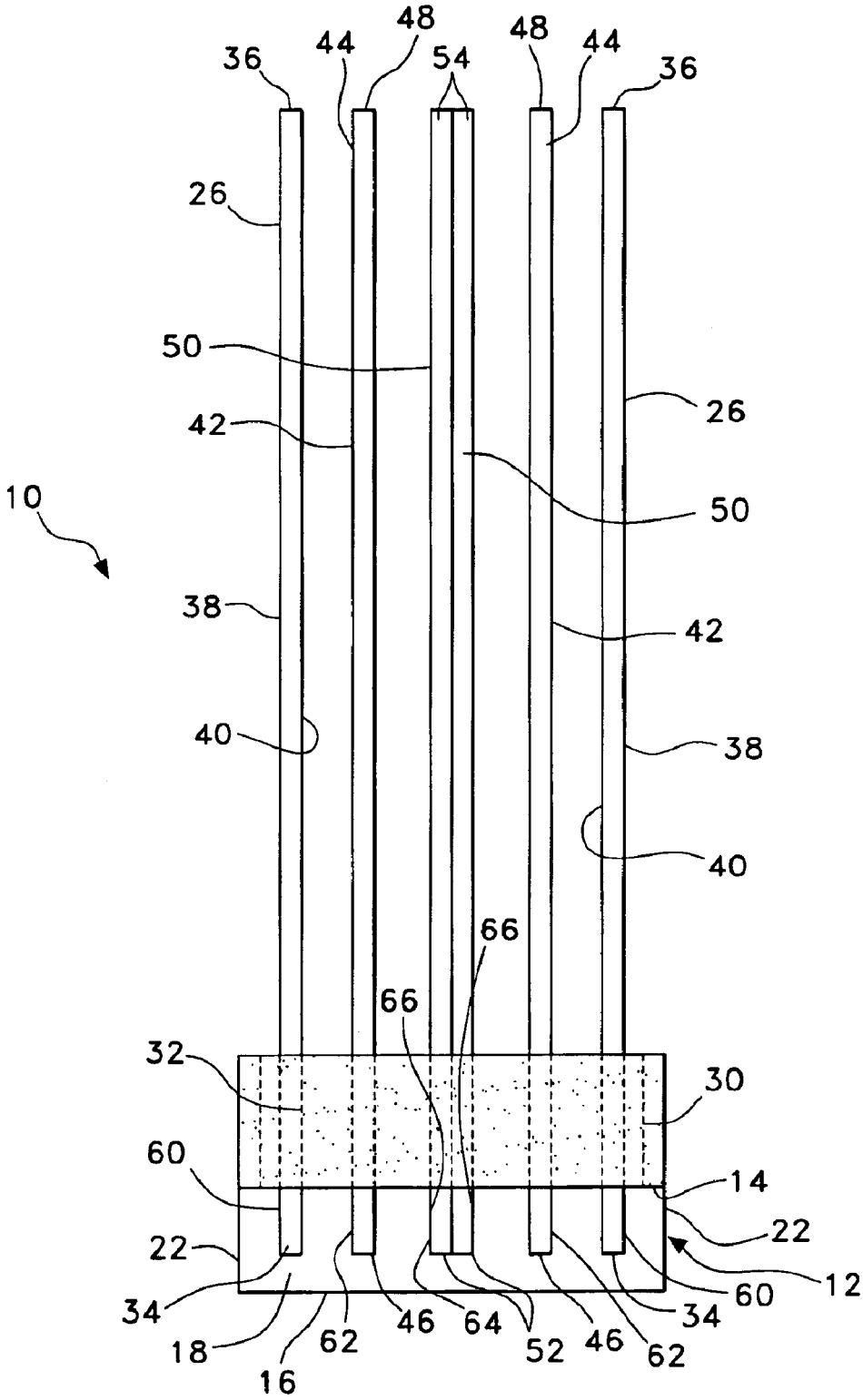
FIG. 2 is a plan view of the golf training aid of FIG. 1.

The present invention is a foldable, air-resistance golf training aid having an elongated flexible hub of rubber or similar material being bendable and stretchable between a rectangular configuration for transport and storage and a generally cylindrical, wrapped configuration fitting around a golf club shaft. The flexible hub has a plurality of parallel, paddle-shaped vanes spaced around and extending radially from the hub along the substantial length thereof when in the stretched, cylindrical, wrapped configuration. The flexible hub assumes the rectangular folded configuration at rest with the vanes parallel to each other to form a compact unit for carrying and storage in a golf bag during a round of golf.

Referring to FIGS. 1–5B, the inventive golf training aid is shown in its folded configuration for carrying and storage. The golf training aid 10 has a generally vertically oriented hub 12 having an outer surface 14, an inner surface 16, an upper end wall 18, a lower end wall 20, and parallel side walls 22 and is generally rectangular in shape as shown in its rest configuration. Parallel vanes 24 extend outward from the outer surface 14 of hub 12 and one or more of the vanes 24 may have a logo 28 thereon. The vanes are preferably of a rigid, clear plastic sheet material about 1/16" in thickness. A plastic having the desired properties is PETG (Polyethylene Terephthalate Glycol) available from K-mac Plastics, Kentwood, Mich.

There are preferably six vanes inserted into corresponding grooves cut lengthwise in the outer side of hub 12 and extending into the hub about two-thirds of the thickness thereof. The vanes 24 are of the same size and configuration and are generally shaped like the end portion of a paddle. The vanes include an outer pair 26, an intermediate pair 42 and a center pair 50. Outer vane pair 26 each has straight inner edges 34 and peripheral edges 36 extending therearound, and have outer sides 38 and inner sides 40 (relative to the remainder of the vanes). One each of outer vane pair 26 is mounted in respective outer vane slots 60 (see FIG. 2) and attached by adhesive (not shown) to the outer side of the respective slot. Intermediate vane pair 44 is mounted in intermediate vane slots 62 in a manner similar to that of outer vane pair 26. Inner vane pair 50 is mounted adjacent within a single central slot 64, the vanes being attached by adhesive to respective opposed walls 66 of slot 64. Fastening straps 30 are of loop material and extend between respective upper and lower sides of outer vane pair 26 at a point proximate their entrance into hub 12.

Figure 4:
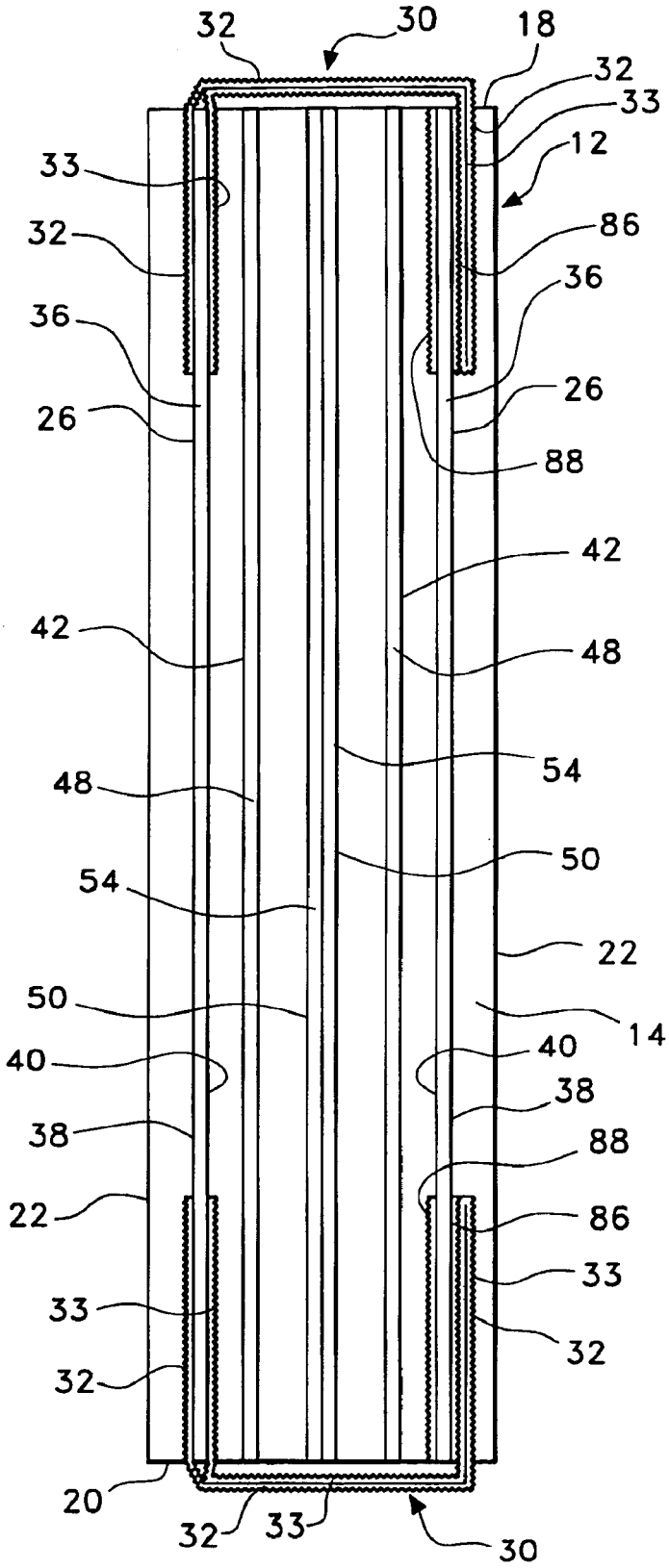
FIG. 4 is a side elevation view of the golf training aid of FIG. 1.

As seen in FIG. 4, fastening straps 30 are made of back-to-back strips including inner loop material strap 32 and outer loop material strap 33. The inner and outer loop material straps are fastened by adhesive over upper and lower ends of one vane of the outer vane pair 26. The inner and outer loop material straps are then combined and the resulting straps extend around the respective ends of the training aid 10, the inner loop strap 32 being removably attached to outer hook material patch 86, thus holding the vanes in the closed position. A key ring 31 may be mounted through one of the fastening straps 30 at one end of the training aid 10 for holding items such as keys, beverage openers, and a spring clip for fastening to a golf bag or cart.

Figure 3:
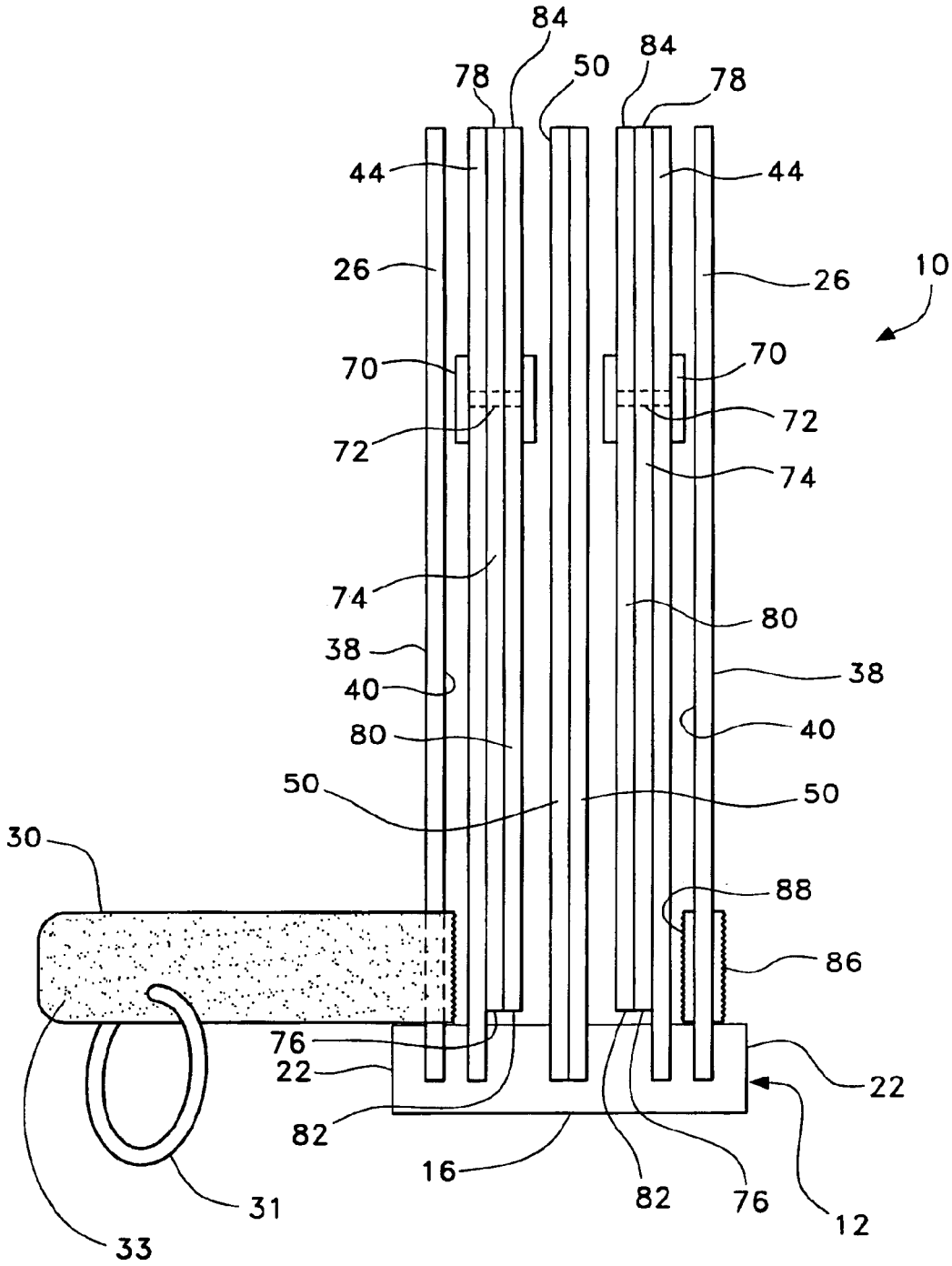
FIG. 3 is a plan view similar to that of FIG. 2, with the strap opened and having extender paddles added.

Referring to FIG. 3, there is shown a fastening strap in the open position with key ring 31 attached thereto as fastened around one of outer vane pair 26. The hook material patch 86 is shown in the unattached state on outer surface 38 of the other vane of vane pair 26. A hook material patch 88 is mounted on the inner surface 40, opposite hook material patch 86 for fastening the strap 30 with the golf training aid 10 in the open position with the hub 12 stretched into the cylindrical, wrapped position around a golf club shaft (see FIG. 8). First extender paddles 74, having straight edges 76 and peripheral edges 78, and second extender paddles 80, having straight edges 82 and peripheral edges 84 are attached to respective vanes of intermediate vane pair 44 by respective rivets 70 having axles 72. The straight edges of the extender paddles are proximate hub outer surface 14 when in the folded position and may be rotated to extended positions (see FIG. 9C).

Referring to FIG. 4, there is shown a side elevation view of the golf training aid of FIG. 1, showing fastening straps 30 in the fastened position at upper end 18 and lower end 20 of the flexible hub 12. The straps 30 are both attached as described above so as to fasten to respective outer hook material patches 86 to maintain the vanes 26 in the closed position. It is noted that in this embodiment of the invention there are no extender paddles 74 and 80.

Figure 5A:
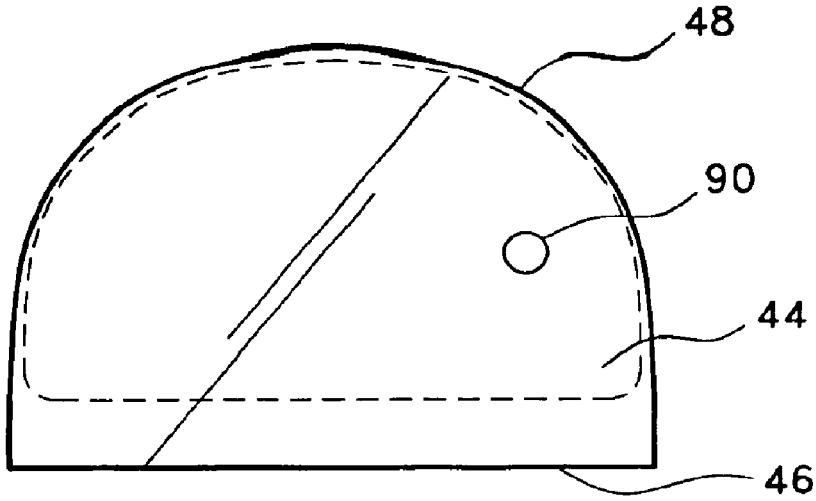
FIG. 5A is a detail view of a paddle of FIG. 3 showing an extender paddle (in ghost lines) mounted thereon.
Figure 5B:
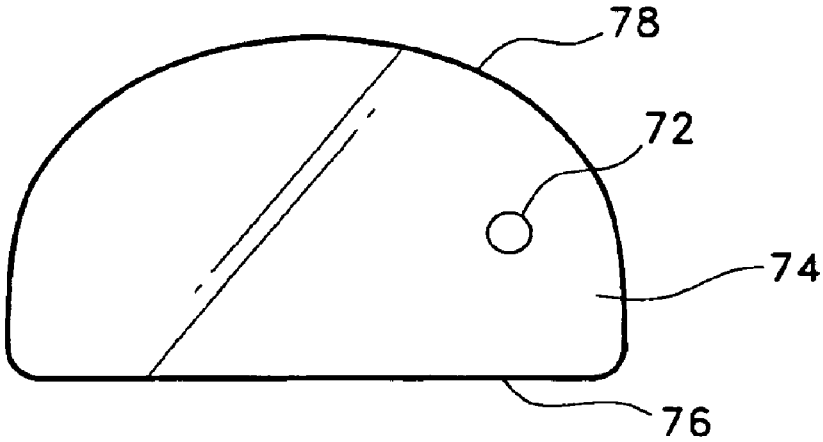
FIG. 5B is a detail view of the extender paddle in FIG. 5.

Referring to FIGS. 5A and 5B, there are shown detail views of the intermediate vane 44, and the first extender paddle 74, respectively. Intermediate vane 44 has a straight inner edge 46 and a peripheral edge 48 and an axle bore 90 for fitting around axle 72. An extender paddle is shown in phantom lines in the folded position on vane 44. First extender paddle 74 is shown in FIG. 5B having a straight inner edge 76 and a peripheral edge 78 and rotatable around axle 72.

Figure 6A:
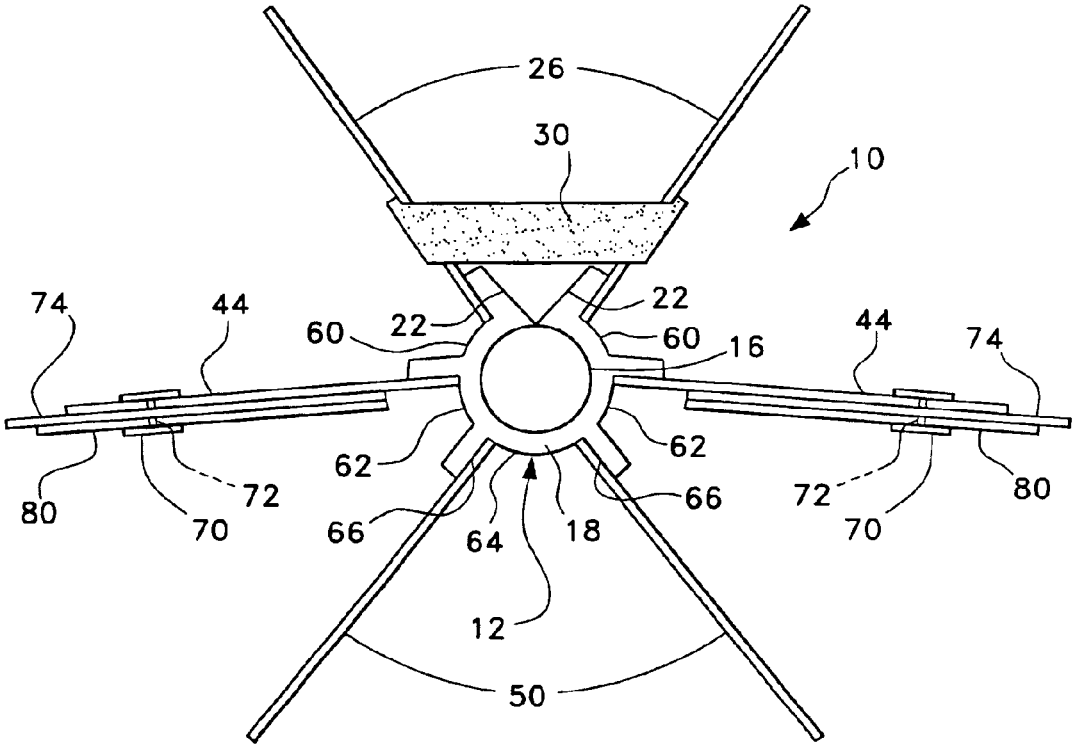
FIG. 6A is a plan view of the golf training aid of FIG. 3 in the cylindrical, wrapped configuration with paddle extenders.
Figure 6B:
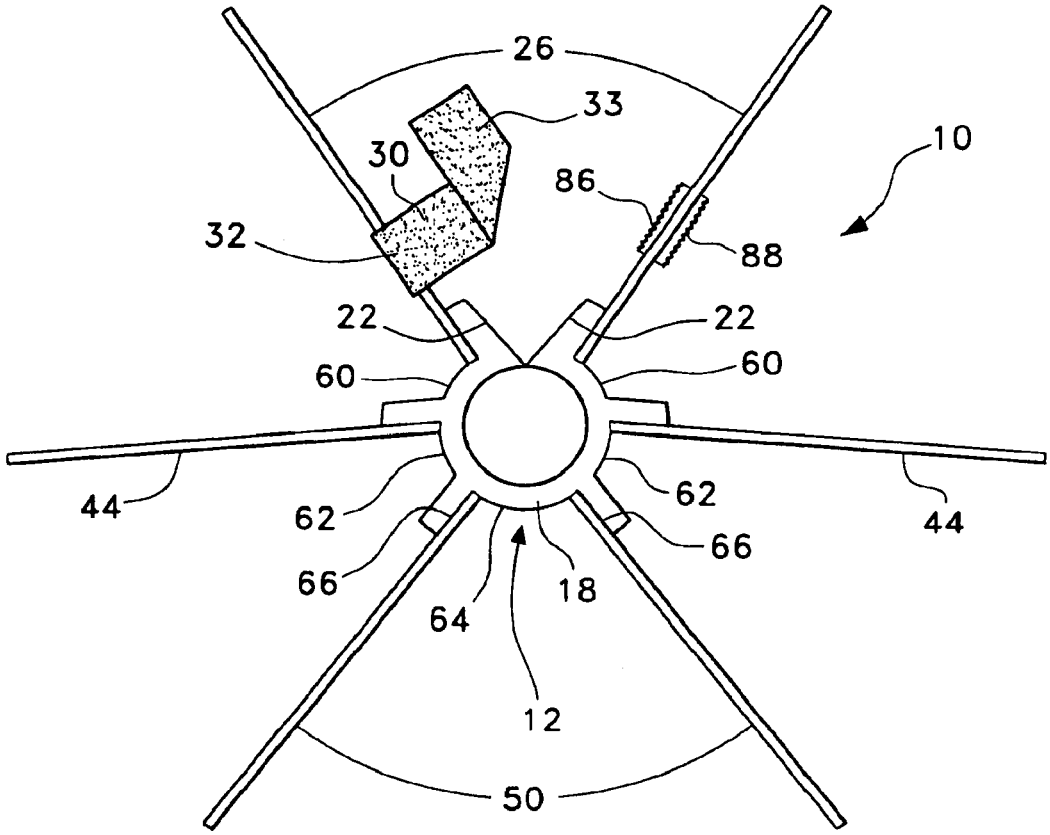
FIG. 6B is a plan view of the golf training aid of FIG. 1 in the cylindrical, wrapped configuration.
Figure 7:
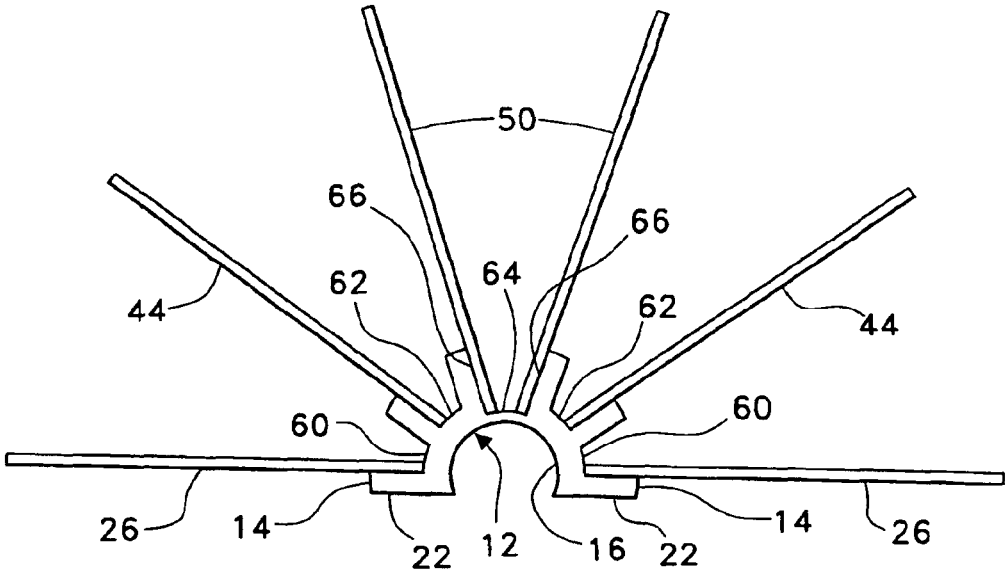
FIG. 7 is a plan view of the golf training aid of FIG. 1 in a partially wrapped configuration.

Referring to FIGS. 6A, 6B, and 7, there are shown plan views of the embodiment of FIG. 3 and that of FIG. 4 in the open configuration with the hub 12 stretched and wrapped into the cylindrical configuration, and of a partially opened embodiment of FIG. 4, respectively. As is seen in FIG. 6A, the outer pair of vanes 26 has been rotated around the hub 12, stretching the hub into a wrapped, cylindrical configuration with inner edges of the parallel sides 22 touching. A fastening strap 30 holds the outer pair of vanes 26 together. In this configuration the hub 12 would be wrapped around the shaft of a golf club (see FIG. 8). As is seen, the outer vane slots 60, the intermediate vane slots 62 and the center slot 64 expand to form the outer surface of the inner cylinder formed by hub 12.

The center vane pair 50 is spread radially and the individual vanes remain attached to the opposed walls 66 of slot 64. The intermediate vane pair 44 is spread radially from respective center vanes 50, the intermediate slots 62 expanding to form the outer surface of the inner cylinder formed by hub 12. The outer vanes 26 are spread radially from respective intermediate vanes 44, the outer slots 60 expanding to form the outer surface of the inner cylinder formed by hub 12. First extender paddles 74 and second extender paddles 80 are mounted for rotation relative to intermediate vanes 44 by rivets 70 having axles 72. The inner circumference of the hub may be adjusted to snugly fit a particular shaft so as to avoid rotation by adjusting length of fastening strap 30, thereby adjusting tension on the portions of hub 12 bounded by sides 22 and outer vanes 26.

Referring to FIG. 6B, the embodiment of the golf training aid 10 of FIG. 4 without extender paddles is shown in a similar view of that of FIG. 5A. In this view the fastener strap is shown peeled away to show loop material layer 33 and hook material patch 88 of VELCRO which adjustably holds the outer vanes 26 in the desired spaced relationship and thus adjusts wrapping tension on hub 12. The golf training aid 10 may be returned to the folded position as in FIG. 1 by releasing the fastener straps 30 from hook material patches 88, folding the vanes 26, and fastening straps 30 by attaching hook material layers 32 to hook material pates 86.

Figure 8:
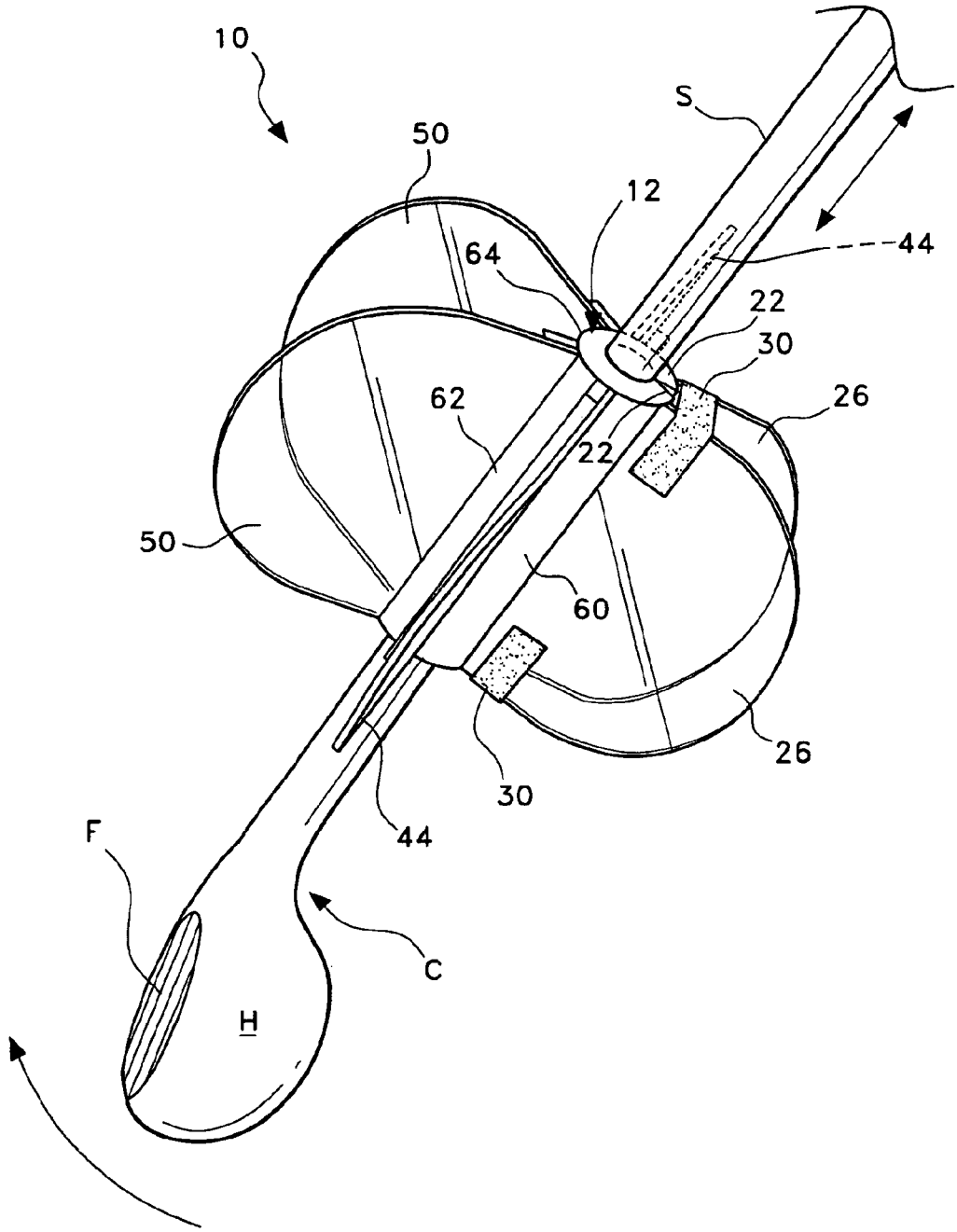
FIG. 8 is an environmental perspective view of the golf training aid of FIG. 1 mounted on the shaft of a golf club.

Referring to FIG. 8, there is shown an environmental perspective view of the inventive golf training aid 10 as mounted on a shaft S of a golf club C having a face F on head H. In the preferred position the golf training aid 10 is mounted on shaft S near the head H for maximum resistance to swing. The resistance to swing may be reduced, if desired, by mounting the golf training aid 10 higher along the shaft S, extending the distance between the aid 10 and the head H. The preferred mounting for aid 10 is illustrated with the center vane pair 50 leading when the club C is swung. The intermediate vanes 44 extend substantially across the line of the swing and outer vanes 26, connected by fastening straps 30, trail the club during the swing. The hub 12 may be moved up or down the shaft S by releasing tension on fastener strips 30, allowing parallel sides 22 to separate, moving the hub 12 to the desired point on shaft S and then tightening the fastener straps so as to hold the golf swing aid 10 in place during a swing. This procedure also provides for attachment to stepped diameter shafts.

Figure 9A:
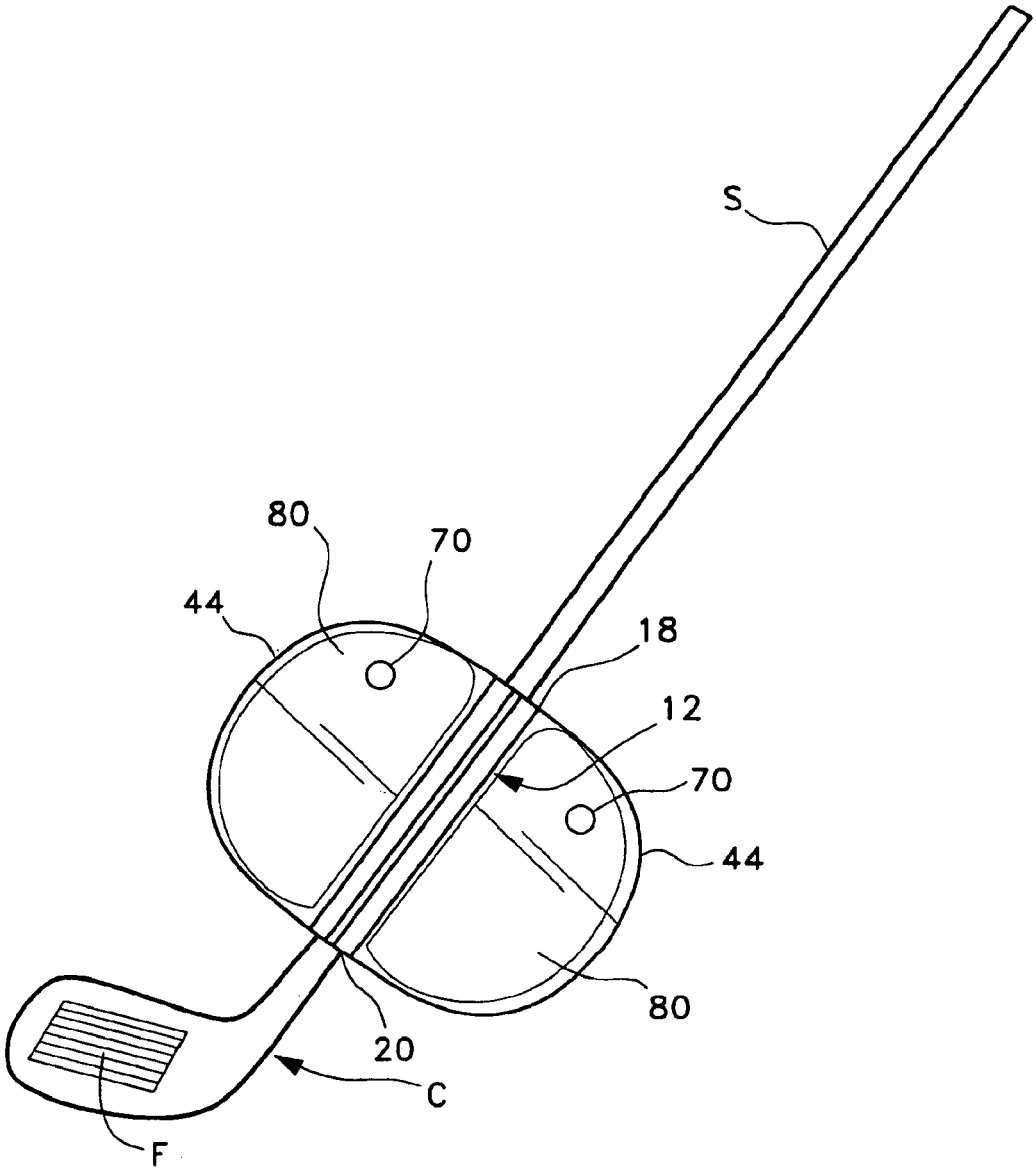
FIG. 9A is a front environmental view of the golf training aid of FIG. 3 as mounted on the shaft of an iron with extender paddles in the fully folded position (center paddle pair deleted).

Referring to FIGS. 9A–9D, there are shown diagrammatic front elevation views of the inventive golf training of the embodiment of FIG. 4 as mounted on a golf club, having two pairs of extender paddles shown in differing configurations to vary air-resistance during the swing of golf club C. The center vane pairs are not shown to more clearly illustrate the intermediate vane pairs with extender paddles. As seen in FIG. 9A, the flexible hub 12 supports intermediate vane pairs 44 with the extender paddles 80 and 74 (not shown) in the closed position over the vane pairs 44.

Figure 9B:
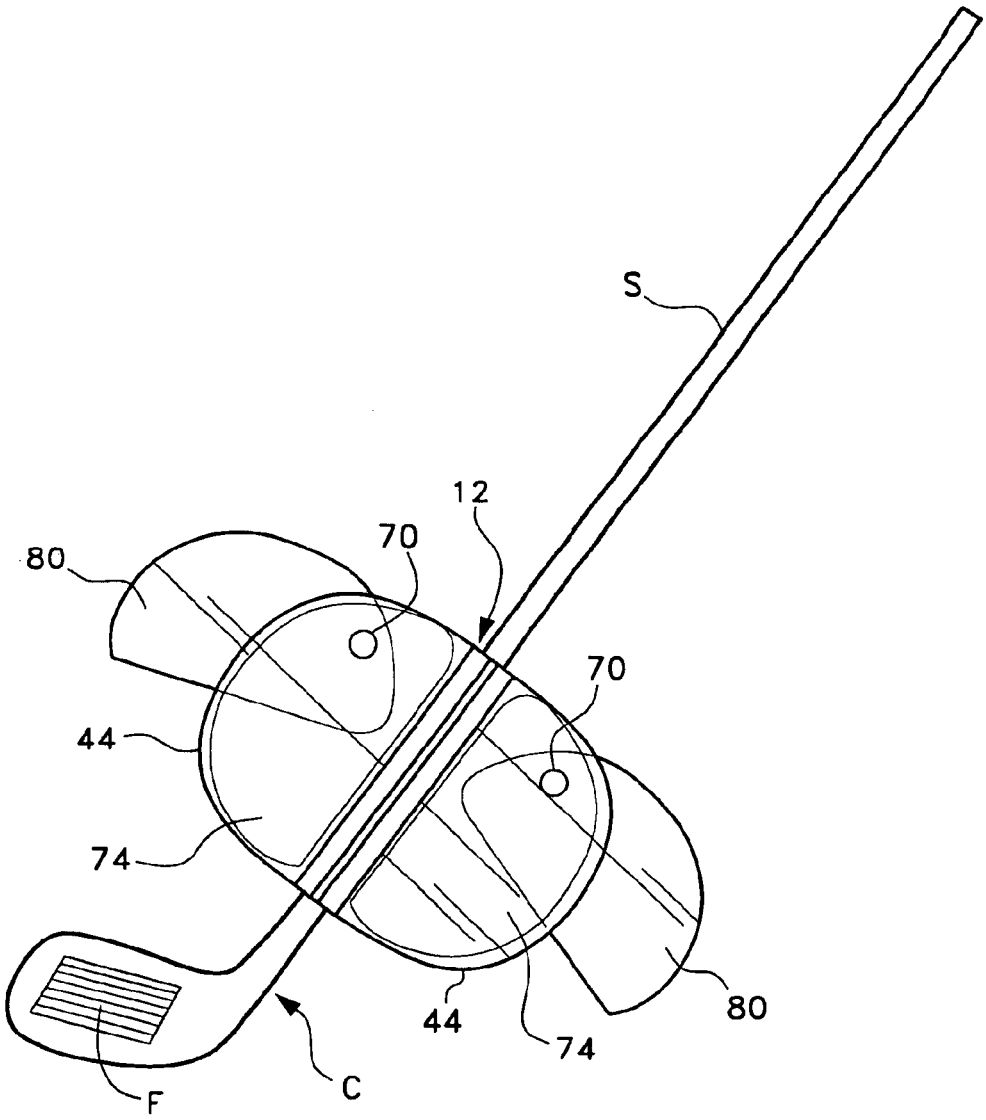
FIG. 9B is a view similar to that of FIG. 9A having a pair of extender paddles in the extended position.
Figure 9C:
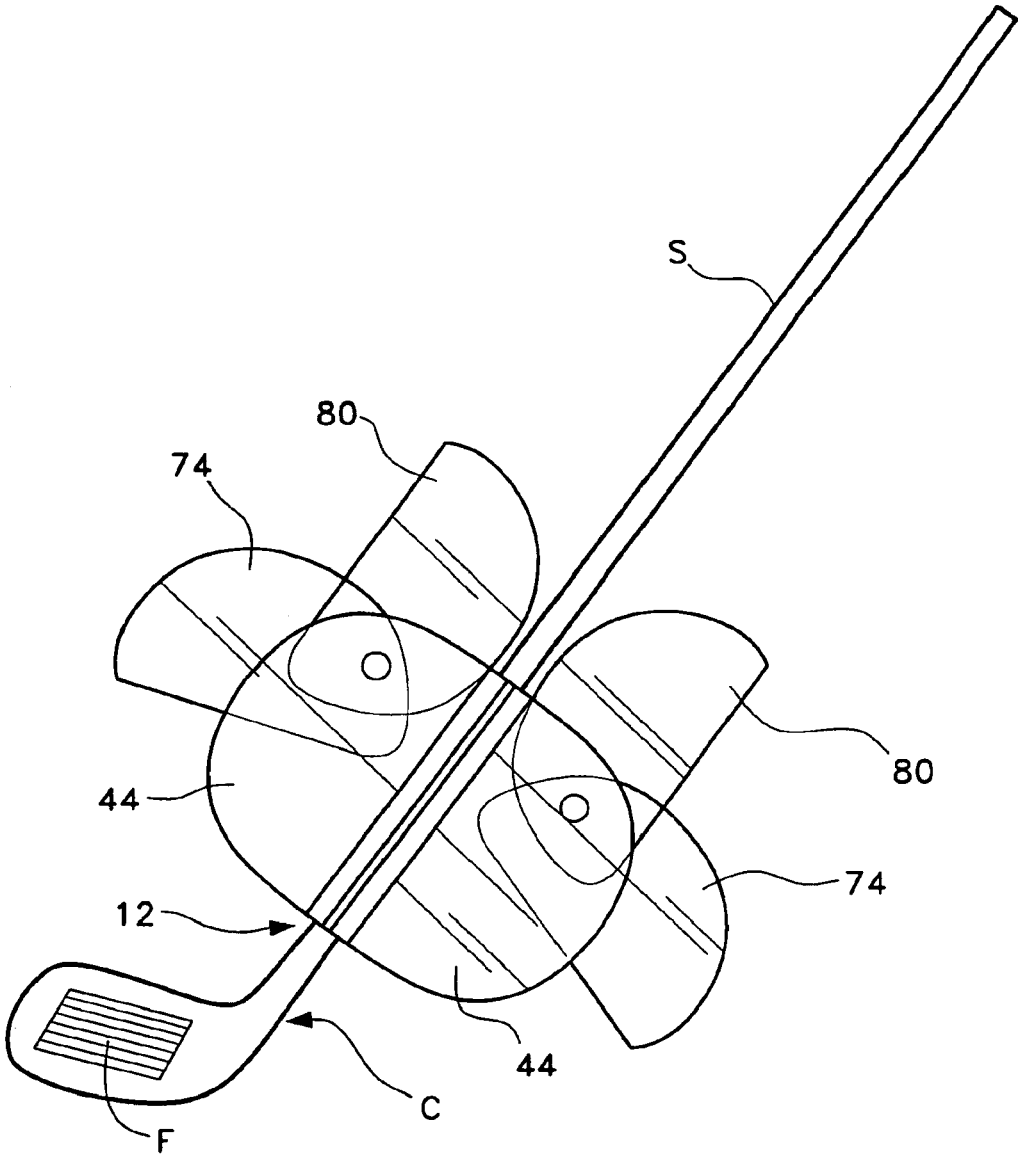
FIG. 9C is a view similar to that of FIG. 9A having two pair of extender paddles in the extended position.
Figure 9D:
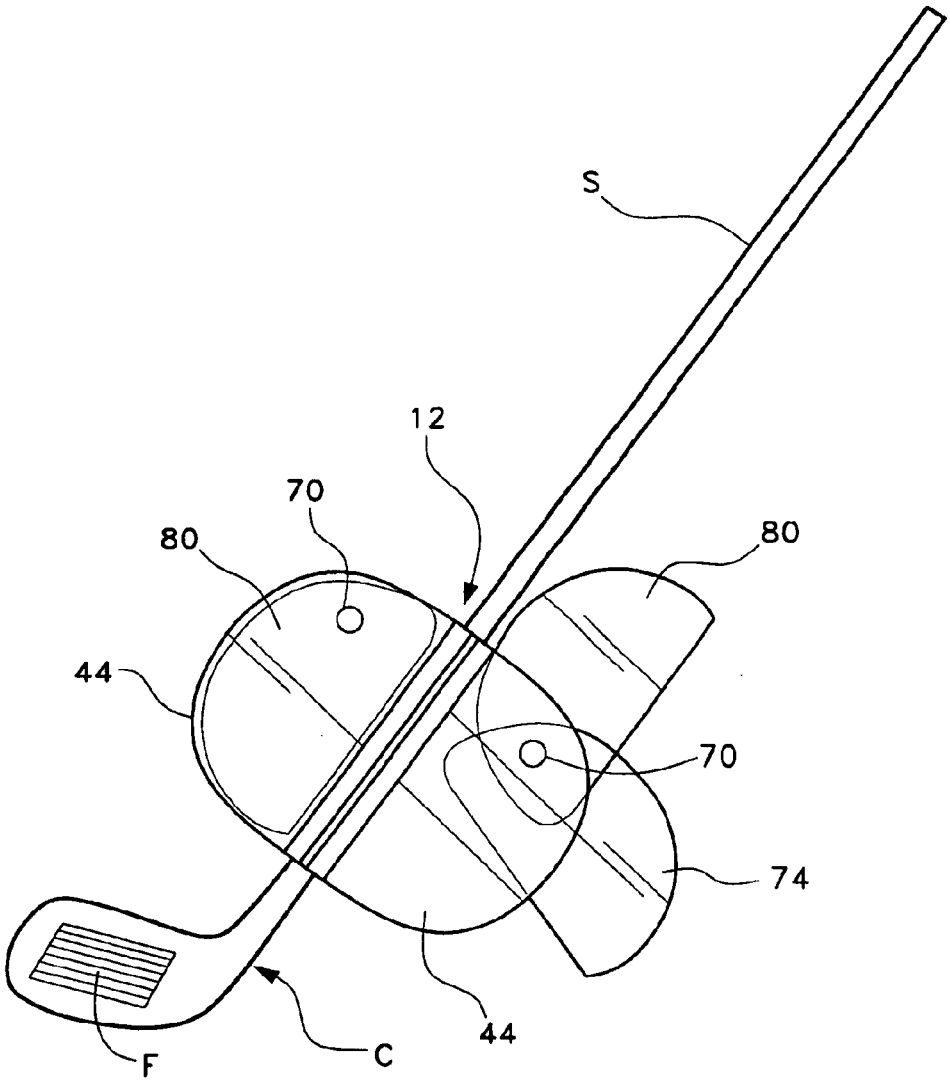
FIG. 9D is a view similar to that of FIG. 9A having one each of two pair of extender paddles in the extended position.
Figure 9E:
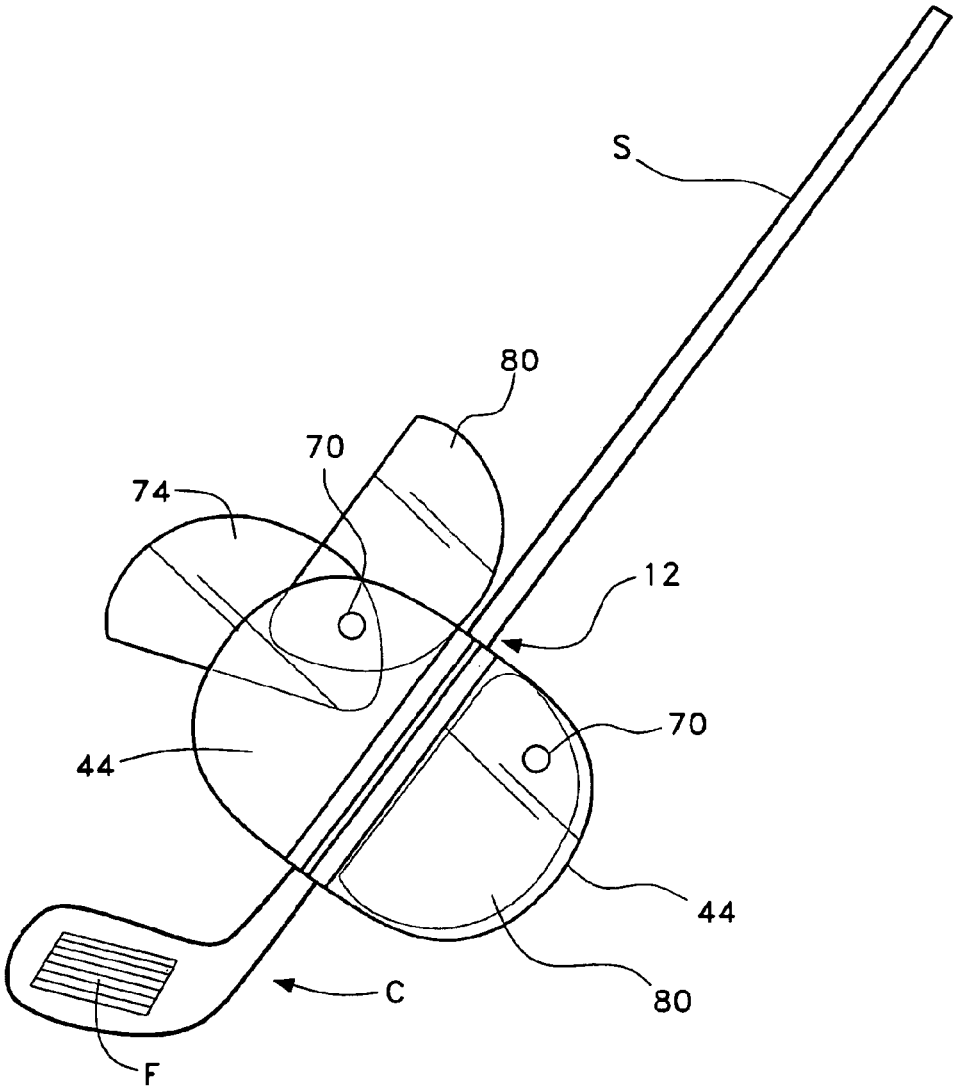
FIG. 9E is a view similar to that of FIG. 9D having the other of two extender paddles in the extended position

FIG. 9B is similar to FIG. 9A where second extension paddles 80 are rotated outward around axle rivets 70, respectively, with the first extender paddles 74 remaining in the closed ore retracted position over intermediate vane pair 44. FIG. 9C is similar to FIG. 9B where second extension paddles 80 are fully rotated and first extension paddles 74 are extended outward from intermediate vane pairs 44, this configuration providing the most air-resistance to the swing. FIG. 9D is similar to that of FIG. 9C with only the lower extension paddles 80 and 74 rotated outward. FIG. 9E is similar to FIG. 9D with only the upper extension paddles 80 and 74 rotated outward around axle rivets 70. The axle rivet 70 preferably holds the extension paddles 80 and 74 and intermediate vanes 44 together sufficiently tightly so that the paddles hold their positions as set by the golfer by friction therebetween.

Figure 10A:
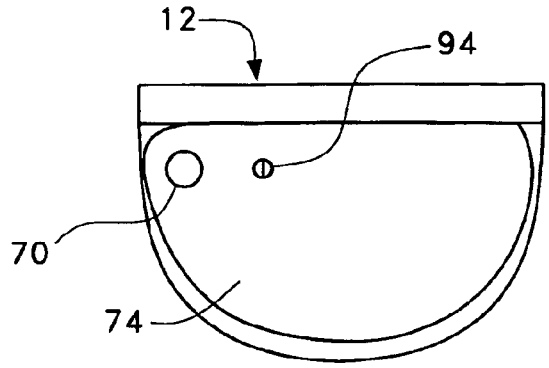
FIG. 10A is a representation of a golf training aid with a single extender paddle in a fully folded position having a detent in a detent receiver.
Figure 10B:
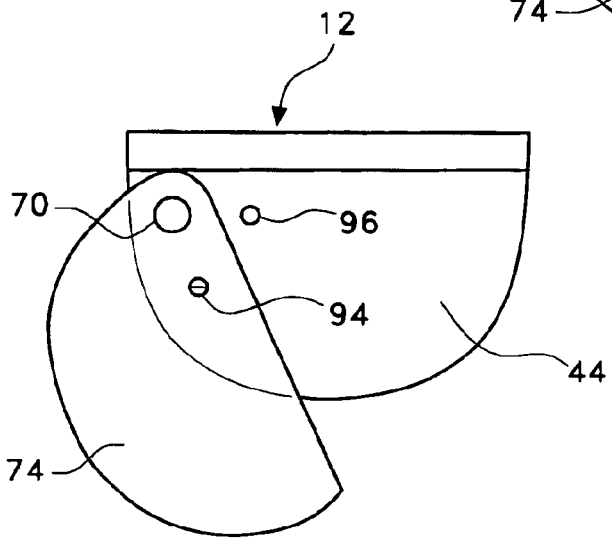
FIG. 10B is a representation of the golf training aid of FIG. 10A with the single extender paddle partially extended with the detent in a second detent receiver and the detent receiver of the fully folded position revealed.
Figure 10C:
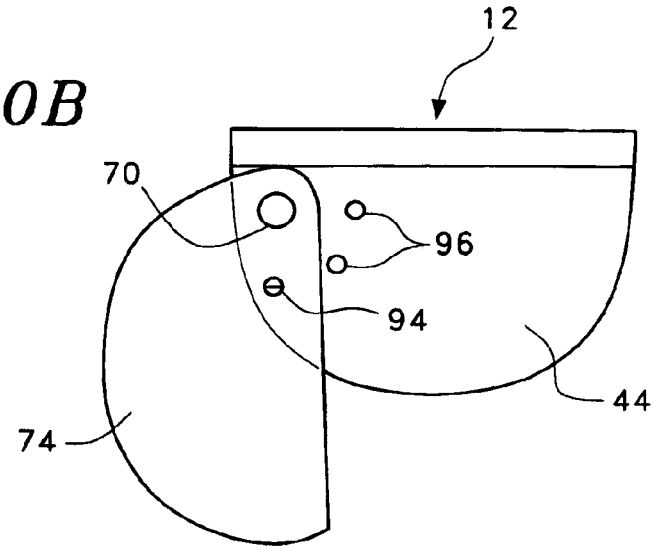
FIG. 10C is a representation of the golf training aid of FIG. 1A with the single extender paddle fully extended with the detent in a third detent receiver and the detent receivers of the fully folded and partially extended positions revealed.

FIG. 10A–10C are detail views illustrating a first extender paddle 74 held in the closed or retracted position, the partially extended position, and the fully rotated position, respectively, around axle rivet 70 relative to center vane 44. Note the rivet axle 70 is located much closer to flexible hub 12 in this embodiment where only one extender paddle is used relative to the rivet axle 70 on the dual extender paddle embodiment of FIGS. 9A–9D, above. FIGS. 10A–10C also show illustrate the use of detents 94 and detent receivers 96 to lock first extender paddle 74 in the closed or retracted position, the partially extended position and the fully rotated position, respectively. Similar detents (not shown) may be used with the embodiment of FIGS. 9A–9D, detents being used between vane 44 and first extender paddle 74 and between first extender paddle 74 and second extender paddle 80. The flexibility of the plastic paddles and vanes allow for the relative movement of the paddles between detent positions.

Figure 11A:
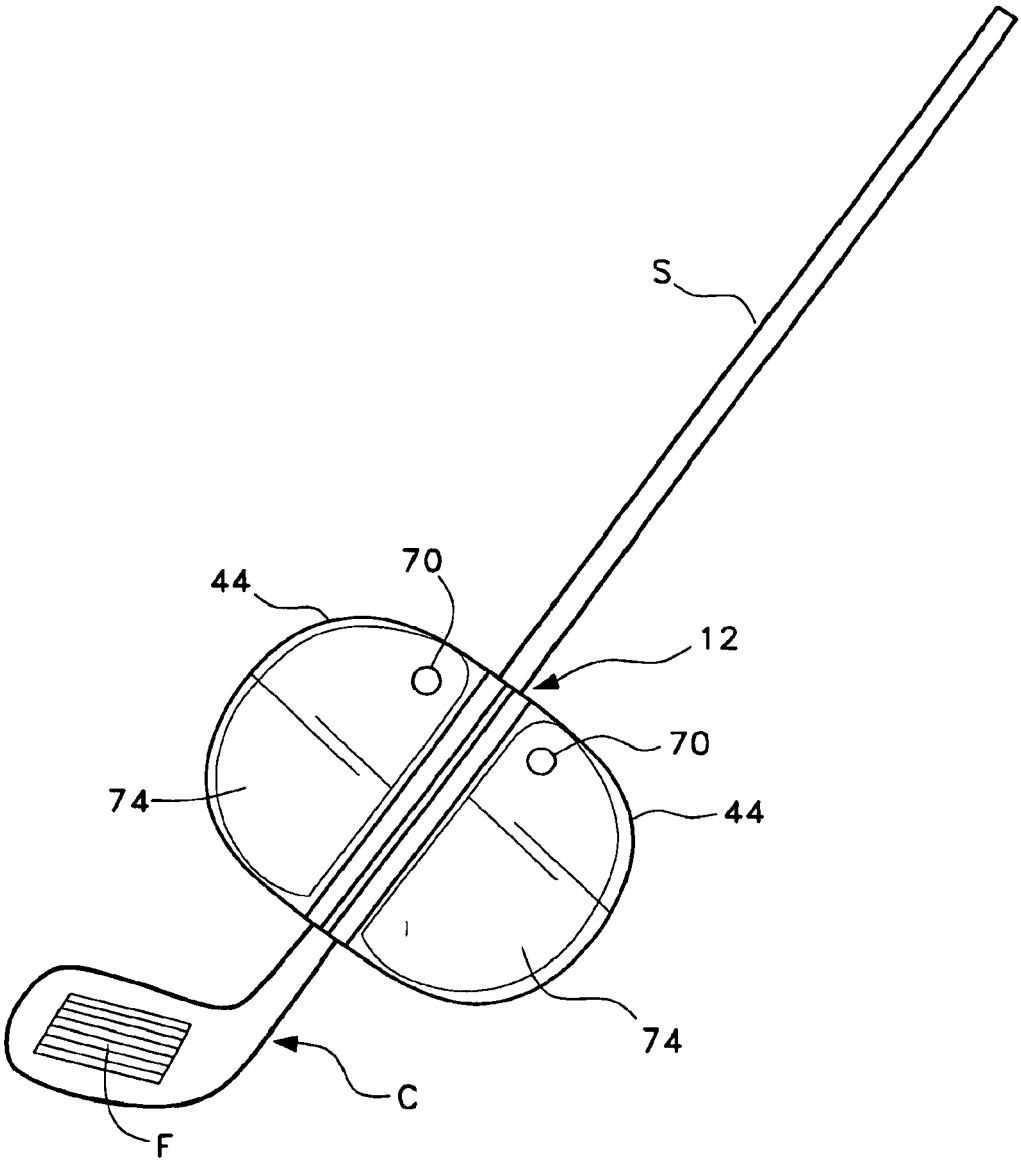
FIG. 11A is a front environmental view similar to that of FIG. 9A of an embodiment having a single pair of extender paddles as shown in a fully folded position.
Figure 11B:
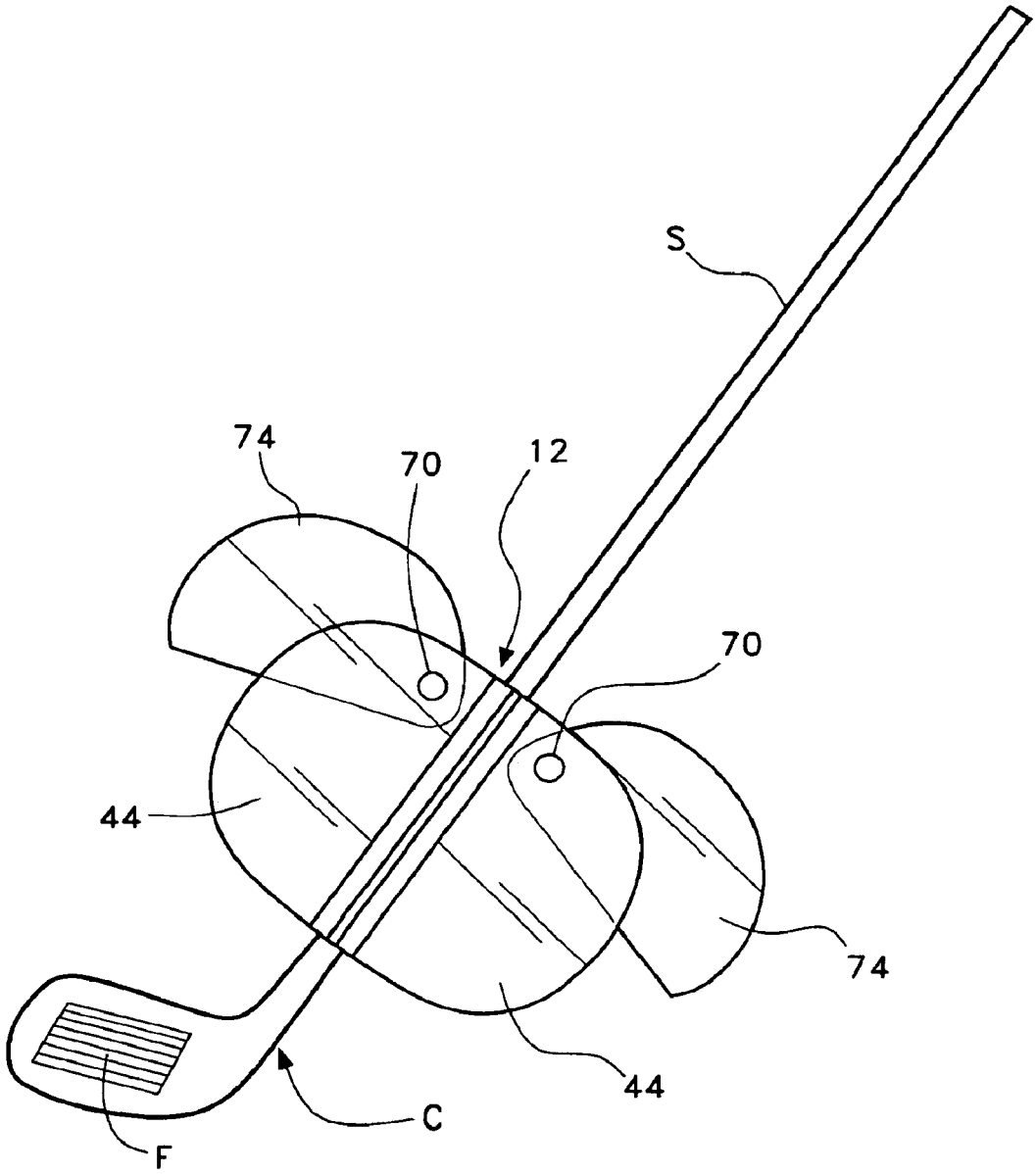
FIG. 11B is a view similar to that of FIG. 11A showing the single pair of extender paddles in an extended position.

Referring to FIG. 11A and 11B, there are shown front elevation views similar to those of FIGS. 9A–9D where single extension paddles 74 are employed with intermediate vanes 44. The extension paddles 74 are located in the closed or retracted position and the partially extended position.

The flexible hub 42 is preferably made of black, ½" thick neoprene rubber with a durometer reading of about 70, or other equivalent materials. The vanes are attached within the grooves by adhesive along their entire length so as to maintain adhesion strength when the hub is stretched around a golf club shaft. The plastic vanes and extender paddles may be in desired colors, by the transparent versions are preferred such that advertising and illustrative inserts may be placed between the vanes and seen by a prospective customer.

In a preferred version the slots are cut into the rubber hub about ⅜" deep and 3/32" wide, the rubber fingers between the slots being about ⅛" in thickness, the thickness of the outer fingers, i.e. the outer slots and the hub parallel walls preferably being about ¼ inch to withstand the force applied when the hub is wrapped around the club shaft. The corners of the rubber hub and the vanes and extender paddles are preferably rounded off for a better appearance.

It is to be understood that the present invention is not limited to the embodiments described above, but encompasses any and all embodiments within the scope of the following claims.

I claim:

1. A foldable, air-resistance golf training aid, comprising:

an elongated, flexible hub having an outer side, an inner side, opposed upper and lower ends, and opposed sides;

a plurality of air resistance vanes extending parallel to and spaced radially outward from said hub;

said hub being foldable between a stretched, wrapped, cylindrical configuration having said opposed sides mutually proximate and a stored generally rectangular rest configuration having said opposed sides mutually remote;

said inner side of said hub in said wrapped, cylindrical configuration being of such circumference as to engage the shaft of a golf club;

said plurality of vanes including a pair of outer vanes proximate respective said opposed sides and at least one intermediate vane;

said pair of outer vanes having at least one securing fastener extending between said pair of outer vanes and holding said hub in said stretched, cylindrical configuration, said securing fastener being detachable from at least one of said pair of outer vanes to allow folding of said hub from said stretched, cylindrical configuration to said stored, rest configuration.

2. The golf training aid of claim 1, said flexible hub defining a plurality of radial, outward opening slots therein having opposed slot walls, each said vane extending into a corresponding slot and mounted to one wall thereof, said securing fastener being a belt.

3. The golf training aid of claim 2, said slots and said vanes extending mutually parallel when said flexible hub is in said stored, rest configuration.

4. The golf training aid of claim 3, wherein said vanes are mounted to said corresponding slot walls by adhesive.

5. The golf training aid of claim 2, wherein said plurality of vanes includes an outer pair and an inner pair of intermediate vanes, said flexible hub defining five radially disposed, outward opening slots therein including a central slot, a pair of intermediate slots and a pair of outer slots, each slot having opposed slot walls, said inner pair of intermediate vanes being mounted to said opposed walls of said central slot, said outer pair of intermediate vanes being mounted to one of said slot walls of said corresponding intermediate slots, and said pair of outer vanes being mounted to one of said slot walls of said corresponding pair of outer slots.

6. The golf training aid of claim 5, further comprising at least one extender paddle and axle rivet, at least one said extender paddle rotatably mounted to each of said pair of intermediate vanes by said axle rivets so as to rotate between a closed position conforming with said vane and a fully open position extending upward from said vane.

7. The golf training aid of claim 6, further comprising first and second extender paddles rotatably mounted to each of said outer pair of intermediate vanes by said axle rivets, each said first extender paddle being rotatable between a closed position conforming with said vane and an intermediate position extending diagonally upward from said vane, each said second extender paddle being rotatable between a closed position conforming with said vane and a fully open position extending upward from said vane.

8. The golf training aid of claim 7, wherein said extender paddles are rotatably mounted to said corresponding intermediate vanes by said axle rivets at a point proximate said upper end of said hub.

9. The golf training aid of claim 8, further comprising detents and detent receivers so located in said intermediate vanes and said rotatably attached first and second extender paddles so as to form interlocks therebetween at said closed, said intermediate, and said fully open positions.

10. The golf training aid of claim 2, said pair of outer vanes having an upper securing strap extending between said pair of outer vanes proximate said upper end of said flexible hub, and a lower securing strap extending between said pair of outer vanes proximate said lower end of said flexible hub.

11. The golf training aid of claim 10, said pair of outer vanes having respective inner and outer sides, each said securing strap being of loop material attached to one of said pair of outer vanes on the inner side thereof, the other of said pair of outer vanes having a hook material patch attached thereto on the inner side thereof so as to removably engage said corresponding strap of loop material, maintaining said hub in said stretched, cylindrical configuration.

12. The golf training aid of claim 11, each said securing strap being double-sided loop material separated and attached to one of said pair of outer vanes on both the inner and outer side thereof, the other of said pair of outer vanes having a hook material patch attached thereto on the outer side thereof so as to removably engage said corresponding strap of loop material maintaining said hub in said storage, rest configuration.

13. The golf training aid of claim 2, further comprising at least one extender paddle and axle rivet, at least one said extender paddle being rotatably mounted to each of said outer pair of intermediate vanes by said axle rivets so as to rotate between a closed position conforming with said vane and a fully open position extending upward from said vane.

14. The golf training aid of claim 13, further comprising first and second extender paddles rotatably mounted to each of said outer pair of intermediate vanes by said axle rivets, each said first extender paddle being rotatable between a closed position conforming with said vane and an intermediate position extending diagonally upward from said vane, each said second extender paddle being rotatable between a closed position conforming with said vane and a fully open position extending upward from said vane.

15. The golf training aid of claim 14, wherein said extender paddles are rotatably mounted to said corresponding intermediate vanes at a point proximate said upper end of said hub.

16. The golf training aid of claim 15, further comprising detents and detent receivers so located in said intermediate vanes and said rotatably attached first and second extender paddles so as to form interlocks therebetween at said closed, said intermediate, and said fully open positions.

17. The golf training aid of claim 15, said stretched, cylindrical hub being positioned relative to the shaft of a golf club such that said outer pair of intermediate vanes located such as to substantially across the path of swing of said golf club shaft such as to provide maximum air resistance to the golf club during the swing thereof.

18. A foldable air-resistance golf training aid, comprising:

an elongated, flexible hub having an outer side, an inner side, opposed upper and lower ends, and opposed sides;

a plurality of air-resistance vanes extending parallel to and spaced radially outward from said hub;

said air-resistance vanes being trasparent;

said hub being foldable between a generally stretched, wrapped, cylindrical configuration having said opposed sides mutually proximate and a stored, generally rectangular rest configuration having said opposed sides mutually remote;

said inner side of said hub in said stretched, cylindrical configuration being of such circumference as to engage the shaft of a golf club;

said plurality of vanes including a pair of outer vanes proximate respective said opposed sides and at least one intermediate vane;

said flexible hub defining a plurality of radial, outward opening slots therein having opposed slot walls, each said vane extending into a corresponding slot and mounted to one wall thereof said pair of outer vanes having at least one securing strap extending between said pair of outer vanes and holding said hub in said tubular configuration, said securing strap being detachable from at least one of said pair of outer vanes to allow folding of said hub from said tubular configuration to said stored configuration.

19. The golf training aid of claim 18, said pair of outer vanes having an upper securing strap extending between said pair of outer vanes proximate said upper end of said flexible hub, and a lower securing strap extending between said pair of outer vanes proximate said lower end of said flexible hub.

20. The golf training aid of claim 19, said pair of outer vanes having respective inner and outer sides, each said securing strap being of loop material attached to one of said pair of outer vanes on the inner side thereof, the other of said pair of outer vanes having a hook material patch attached thereto on the inner side thereof so as to removably engage said corresponding strap of loop material, maintaining said hub in said stretched, cylindrical configuration.

* * * * *